US005447593A

United States Patent [19]

Tanaka et al.

[11] Patent Number: 5,447,593

[45] Date of Patent: Sep. 5, 1995

[54] METHOD FOR REINFORCING CONCRETE STRUCTURES

[75] Inventors: Tuneo Tanaka; Kensuke Yagi; Tokitaro Hoshijima, all of Yokohama, Japan

[73] Assignees: Mitsubishi Chemical Corporation, Tokyo; Ohbayashi Corporation, Osaka, both of Japan

[21] Appl. No.: 229,119

[22] Filed: Apr. 18, 1994

Related U.S. Application Data

[63] Continuation of Ser. No. 991,708, Dec. 16, 1992, abandoned, which is a continuation of Ser. No. 460,987, Jan. 4, 1990, abandoned.

[30] Foreign Application Priority Data

Jan. 12, 1989 [JP] Japan ..... 1-5582

[51] Int. Cl.[6] ..... B32B 31/12; C09J 5/02; E04C 2/22; E04F 13/02

[52] U.S. Cl. ..... 156/307.3; 156/306.9; 156/71; 52/746.1; 52/DIG. 7; 52/723.1; 52/309.1

[58] Field of Search ..... 156/71, 307.3, 310, 156/315, 330, 307.1, 306.9; 52/724, 725, 727, 167, DIG. 7, 746

[56] References Cited

U.S. PATENT DOCUMENTS

| | | | |
|---|---|---|---|
| 2,850,890 | 9/1958 | Rubenstein | 52/DIG. 7 |
| 3,111,569 | 11/1963 | Rubenstein . | |
| 3,765,972 | 10/1973 | Wesp | 156/71 |
| 4,451,317 | 5/1984 | Oizumi et al. | 156/315 |
| 5,308,430 | 5/1994 | Saito et al. | 156/307.1 |

FOREIGN PATENT DOCUMENTS

| | | |
|---|---|---|
| 0206591 | 12/1986 | European Pat. Off. . |
| 1451643 | 9/1966 | France . |
| 2594871 | 8/1987 | France . |
| 2909179 | 11/1980 | Germany . |

*Primary Examiner*—Michael W. Ball
*Assistant Examiner*—Francis J. Lorin
*Attorney, Agent, or Firm*—Oblon, Spivak, McClelland, Maier & Neustadt

[57] ABSTRACT

A method for reinforcing a concrete structure is disclosed in which the steps of (a) applying to a long fiber prepreg an adhesive, (b) attaching on the surface of the concrete structure the long fiber prepreg with the adhesive interposed between the surface of the concrete structure and the long fiber prepreg, and (c) curing the thermosetting resin at an ambient temperature are performed. The long fiber prepreg has as a matrix a thermosetting resin with a curing temperature of 70° C. or above. The adhesive has a curing temperature of from 10° to 40° C., and accelerates the curing of the thermosetting resin impregnated in the long fiber prepreg.

17 Claims, 1 Drawing Sheet

METHOD FOR REINFORCING CONCRETE STRUCTURES

The present application is a continuation of application Ser. No. 07/991,708, filed Dec. 16, 1992, abandoned, which is a continuation of application Ser. No. 07/460,987, filed Jan. 4, 1990, abandoned.

BACKGROUND OF THE INVENTION

This invention relates to a method for reinforcing existing concrete structures.

In many cases, various existing concrete structures require reinforcement against earthquake, because they were constructed under old design standards and guidelines, and thus are inferior in their aseismatic performance in comparison with those concrete structures constructed by the current standards. Also, in many cases, such reinforcement of the existing concrete structures is necessary for the sake of increasing the number of storeys of the buildings at the time of extending and/or remodelling them so as to be more durable against the designed load.

As the typical method for reinforcement against the earthquake according to the conventional technique, there have been proposed various ones, according to which the existing column members are enclosed with steel plates, or such existing column members are enveloped with welded metal nets or reinforcing steel cages, in an attempt to improve, in the main, toughness of the column members, i.e., in an effort not to reduce the loading capability and the energy absorbing capability, even if such structural elements are subjected to a certain degree of damages such as cracks, etc.

These reinforcing methods, however, are not free from various points of problem such that they inevitably necessitate the welding work of the steel plate at the construction site, and, in order to obtain the desired reinforcement, the welding work must be done by skilled welders; that transportation of steel plates into the existing building is difficult to be attained by the use of heavy machinery, and cutting these steel plates into a size which can be carried by man power would inevitably increase the amount of welding work at the construction site; and that it is also necessary to pour mortar between the existing column members and the steel plates, the welded metal nets, or the reinforcing steel cages to attain transmission of stress between them, but it has been difficult to charge such mortar to a sufficiently dense and compact degree.

Furthermore, the above-mentioned reinforcing methods contributes generally to increase only the shear strength of the existing column members, and, in order to bring their bending strength to a degree which is as equal as before the reinforcement, it is necessary to provide slits in the reinforcing members such as steel plates, etc. However, with such slits being formed in the reinforcing members which are to be exposed to the outer surface of the building construction, water-tightness at these slitted portion would become inferior with the consequence that troubles to derive from water leakage tend to arise not infrequently. In addition, necessity arises for treatment of the steel plates against rust, which, in turn, would inevitably increase maintenance cost.

There has also been proposed a method, in which the bending strength of the concrete structure is reinforced by attaching steel plates onto it by use of both anchor bolts and adhesive agent or grout. This method, however, is not always satisfactory in respect of both cost and working period for the reinforcement.

There has also been proposed another reinforcing method, in which high mechanical strength fiber in the form of a fiber-reinforced plastic (FRP) is attached to the concrete structure with use of adhesive agent. This method of working, however, has its own point of problem such that the pre-fabricated fiber-reinforced plastic components are required to be adhered at the construction site, on account of which, when the object to be reinforced is large in size, the FRP component must be divided into small sub-components for the construction. Moreover, depending on the configuration of the object to be reinforced, the work inevitably becomes complicated.

SUMMARY OF THE INVENTION

In view of the above-mentioned various points of problem inherent in the conventional method of reinforcement in the existing concrete structures, it is the principal object of the present invention to provide a reinforcing method which is capable of applying effective reinforcement to those structural elements of the concrete structures such as pier, chimney, columns, beams, slab, and so forth, and which is easy to implement.

According to the present invention, in general aspect of it, there is provided a method for reinforcing concrete structures, which comprises attaching, on the surface of structural elements of concrete to be reinforced, at least one sheet of long fiber prepreg in an uncured state by use of a normal temperature setting type adhesive agent.

The foregoing object, other objects as well as specific construction of the invention such as reinforcing material and adhesive agent to be used, and others will become more apparent and understandable from the following detailed description thereof, when read in conjunction with the accompanying drawing.

DESCRIPTION OF THE PREFERRED EMBODIMENTS

Figure 1:
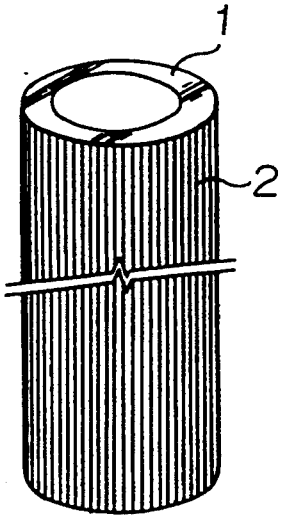
FIG. 1 is a schematic perspective view illustrating a part of an iron-rod-reinforced concrete chimney, on which sheets of long fiber prepreg are laminated.

The long fiber prepreg in an uncured state to be used for the purpose of the present invention is in a planar shape having a thickness of about 0.1 to 2 mm. It is fabricated by impregnating a sheet of reinforcing fiber such as glass fiber, carbon fiber, etc., which are knitted, woven, arranged at random, arranged either monoaxially or biaxially, or otherwise, with use of a thermosetting resin, as the matrix, such as phenolic resin, epoxy resin, unsaturated polyester resin, diallylphthalate resin, bis-maleimide resin, polyimide resin, polyamideimide resin, polyurethane resin, and so forth. A preferred prepreg is a high temperature setting type prepreg having a curing-temperature of 70° C. or above.

As the long fiber, there may be used glass fiber, carbon fiber, poly(vinyl alcohol) fiber, ARAMIDE fiber, silicon carbide fiber, boron fiber, ceramic fiber, metal fiber, nylon fiber, polyester fiber, and so forth.

The above-mentioned long fibers and thermosetting resins may be selected depending on the purpose of their use, and two or more kinds of them may be used in combination.

Of various long fiber prepregs, those having high mechanical strength and high modulus of elasticity may preferably be used, since they have remarkable effect in preventing deformation of the concrete structures at the time of their reinforcement.

The normal temperature setting type adhesive agent to be used for the present invention may be any one of general use. Examples are those adhesive agents of urea resin, resorcin resin, phenolic resin, epoxy resin, etc., as the base, to which a curing agent is admixed in a manner to be able to cure at a normal temperature. As the base, selected use of those resins which are similar to the synthetic resins as the matrix for the long fiber prepreg to be used is preferable for the sake of maintaining integrity of the base with the prepreg and the normal temperature setting type adhesive agent. A preferred example of the normal temperature setting type adhesive-agent which becomes cured at a temperature range of from 10° C. to 40° C. may be such one that can be obtained from mixing of bisphenol A type epoxy resin as the base and an amine type curing agent. For use in the present invention, the adhesive agent should preferably be prepared to have its viscosity of 6,000 cp or below at a temperature of 23° C. The solvent to be used for preparing the adhesive agent-may be any one that can dissolve epoxy resin. Examples of such solvent are thinner, methyl ethyl ketone, acetone, and others. In order to bring the viscosity of the adhesive agent to be 6,000 cp or below at a temperature of 23° C., the resin content should be 300 parts by weight or below, or more preferably from 30 to 100 parts by weight, with respect to 100 parts by weight of the solvent. This adhesive agent should preferably be impregnated in, or applied to, the prepreg immediately before its adhesion to the object to be reinforced. Such impregnation or application of the adhesive agent may be selected in a range of time within one hour immediately prior to commencement of adhesion of the prepreg. Quantity of impregnation or application of the adhesive agent may be in a range of from 10 g to 200 g, or more preferably from 20 g to 100 g, with respect to 1 sq.m ($m^2$) of the prepreg.

According to the present invention, curing of the long fiber prepreg, which takes time for its curing at a normal temperature, is accelerated by bringing this normal temperature setting type adhesive agent into contact with the long fiber prepreg in its uncured state, thereby contributing to the manifestation of the mechanical strength for the required reinforcement in a relatively short period of time.

Further, since the present invention uses the long fiber prepreg which is lighter in weight than steel plate, the reinforcing material can be made light in weight.

With a view to enabling those persons skilled in the art to put the present invention into practice, the following preferred embodiments are presented in reference to the accompanying drawing. It should, however, be noted that these embodiments are illustrative only and not so restrictive, and that any changes and modifications may be made to the them, by those persons skilled in the art, without departing from the spirit and scope of the invention as recited in the appended claims.

Figure 2:
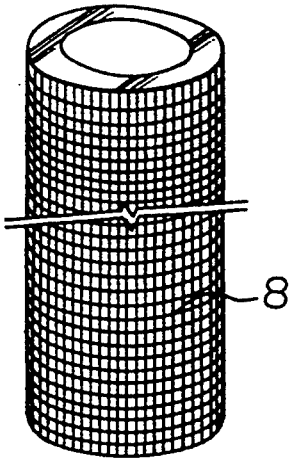
FIG. 2 is also a schematic perspective view illustrating a part of the chimney, on and around which a high strength long fiber strand is wound.
Figure 3:
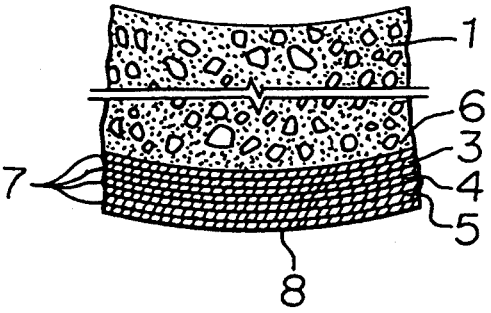
FIG. 3 is an enlarged cross-sectional view showing the reinforced part of a structure.

FIG. 1 is a schematic perspective view illustrating a part of an iron-rod-reinforced concrete chimney 1, on and around which a long fiber prepreg 2 is adhered in accordance with the method of the present invention; FIG. 2 is also a schematic perspective view illustrating a part of the chimney 1, on and around which a high strength long fiber strand 8 is wound; and FIG. 3 is an enlarged cross-sectional view showing a part of a structure, on which the long fiber prepreg is adhered in three layers.

In the following, the method of the present invention will be explained with reference to FIG. 3. First of all, in order to obtain favorable affinity between the iron-rod-reinforced concrete chimney 1 and the adhesive agent 7, a penetrating primer 6 is applied onto the outer surface of the chimney 1. As the penetrating primer 6, those of the same kind as the adhesive agent may preferably be used for improvement in the affinity for the adhesive agent. After the penetrating primer 6 will have been cured, the normal temperature setting type adhesive agent 7 will be applied. The normal temperature setting type adhesive agent should preferably be used by properly diluting it with a thinner for its better working efficiency.

After the normal temperature setting type adhesive agent 7 has been applied, the long fiber prepreg 3 as the first layer is adhered onto the object to be reinforced. In case the long fiber prepreg is the one which is fabricated by uni-directionally arranging the long fibers, the prepreg should be adhered in such a manner that the orientation of the long fibers may become coincident with the direction of the longitudinal axis of the chimney for the sake of exhibiting the reinforcing effect of the mechanical strength of the prepreg.

After the long fiber prepreg 3 has been adhered, the normal temperature setting type adhesive agent 7 is applied onto the surface of the long fiber prepreg 3, and, immediately thereafter, the long fiber prepreg 4 as the second layer is adhered in the same manner as the first layer of the long fiber prepreg 3, followed by application of the normal temperature setting type adhesive agent 7. After this, the long fiber prepreg 5 as the third layer is adhered in the same manner, preferably followed by application of the normal temperature setting type adhesive agent 7.

As soon as the normal temperature setting type adhesive agent 7 completes its curing, the reinforcing work according to the method of the present invention is finished.

The above explanations in reference to FIG. 3 is for the case, in which the long fiber prepreg is laminated in three layers, although the number of lamination may be selected depending on the required quantity of reinforcement and the strength of the long fiber prepreg per one sheet thereof.

FIG. 2 illustrates a case, wherein a high strength long fiber strand 8 is further wound on and around the long fiber prepreg already adhered onto the chimney shown in FIG. 1. In winding the high strength long fiber strand 8, it is preferred that a synthetic resin film such as polyester film, as a separation material for preventing adhesion between the wound layers of the normal temperature setting type adhesive agent and the high strength long fiber strand, is coated on the surface of the topmost layer of the normal temperature setting type adhesive agent 7, and then the high strength long fiber strand 8 should preferably be wound on and around this synthetic film. In this case, the high strength long fiber strand 8 is wound, while it is being impregnated with the resin. As the resin for this purpose, those which have no adhesivity with the separation material, or those having low adhesive strength with it will be adopted. In this way, the wound layer of the high strength long fiber strand 8 is maintained its separation from the topmost layer of the normal temperature setting type adhesive layer 7.

The long fibers to be used as the high strength long fiber strand 8 are as follows: glass fiber, carbon fiber, poly(vinyl alcohol) fiber, ARAMIDE fiber, silicon carbide fiber, boron fiber, ceramic fiber, metal fiber, nylon fiber, polyester fiber, and so forth. Two or more kinds of these fibers may be used in combination. The filament number of these fibers may be appropriately selected depending on the strength required of them.

As the separation material, those materials such as polyester film, as has been exemplified in the foregoing, which has no adhesivity or low adhesive strength with the fiber-reinforced resin should preferably be selected for achieving sufficient separation between the wound layers of the high strength long fiber strand and the long fiber prepreg layer.

It is also feasible that, after the topmost layer of the normal temperature setting type adhesive agent becomes completely cured, the high strength long fiber strand 8 is wound on and around the object to be reinforced, and then a resin having a low adhesive strength with the topmost layer of the normal temperature setting type adhesive agent is impregnated in the high strength long fiber strand 8, thereby being able to omit the above-mentioned separation material. Also, as the separation material, it is feasible to apply oil paint, or the like on this topmost layer of the normal temperature setting type adhesive agent, instead of the synthetic resin film.

The topmost layer of the normal temperature setting type adhesive agent is not always required to be separated from the wound layer of the high strength long fiber strand. In this case, there is no necessity for limitation, as mentioned above, to the kind of the reinforcing resin to be impregnated in the high strength long fiber strand.

As has so far been described in the foregoing, the present invention provides the method, according to which the uncured long fiber prepreg can be adhered onto the surface of the concrete structure, while sufficiently following its irregularities. Also, since the stress from the concrete structure can be easily transmitted, the mechanical strength of the long fiber, as the reinforcing material, can be sufficiently taken advantage of, whereby the improved method for reinforcement is provided.

Further, the present invention provides the reinforcing method, by which sufficient reinforcement can be easily effected on the object to be reinforced however complicated the surface configuration of the constituent element of the concrete structure may be, such as curved surface, etc.

Furthermore, the present invention provides a method of reinforcement, by which the combined use of the long fiber prepreg in an uncured state and the normal temperature setting type adhesive agent makes it unnecessary to adopt any special process step such as curing under heat, etc., whereby the reinforcement of the object to be reinforced by curing of the prepreg can be exhibited in a short period of time.

Moreover, the present invention provides the method of reinforcement, by which use of the long fiber of a high specific strength as the reinforcing material can remarkably suppress weight-increase due to the reinforcement, which makes it unnecessary to expand the area for the reinforcement or to reinforce the base.

In addition, the present invention provides the method, by which the reduction in weight of the reinforcing material makes it possible to easily transport the material without use of a heavy lifting machinery, etc., and also renders the adhering work simple and easy.

What is claimed is:

1. A method for reinforcing a concrete structure, comprising applying to a long fiber prepreg an adhesive having a curing temperature of from 10° to 40° C., said long fiber prepreg having as a matrix a thermosetting resin with a curing temperature of 70° C. or above, attaching on the surface of said concrete structure the long fiber prepreg with the adhesive interposed between said surface of said concrete structure and said long fiber prepreg, and curing the thermosetting resin at an ambient temperature with the adhesive, wherein said adhesive accelerates the curing of said thermosetting resin impregnated in said long fiber prepreg.

2. A method according to claim 1, wherein said long fiber is selected from the group consisting of glass fiber, carbon fiber, and ARAMIDE fiber.

3. A method according to claim 1, wherein the base for said adhesive is an epoxy resin.

4. A method according to claim 3, wherein said epoxy resin is a bisphenol A type epoxy resin.

5. A method according to claim 3 or 4, wherein said adhesive further comprises an amine curing agent.

6. A method according to claim 1, wherein said adhesive is dissolved in a solvent to have its viscosity of 6,000 cp or below at a temperature of 23° C.

7. A method according to claim 1, wherein said prepreg has a thickness from about 0.1 to 2 mm.

8. A method according to claim 1, wherein said adhesive is applied to said prepreg within one hour prior to attaching said prepreg to said surface to be reinforced.

9. A method according to claim 1, wherein said adhesive is applied to said prepreg in an amount in a range of from 10 g to 200 g, with respect to 1 $m^2$ of said prepreg.

10. A method according to claim 9, wherein said amount of said adhesive is from 20 g to 100 g.

11. A method according to claim 8, wherein said adhesive is applied to said prepreg in an amount in a range of from 10 g to 200 g, with respect to 1 $m^2$ of said prepreg.

12. A method according to claim 11, wherein said amount of said adhesive is from 20 g to 100 g.

13. A method according to claim 1, wherein said curing is conducted at a temperature of from 10° C. to 40° C.

14. A method according to claim 8, wherein said curing is conducted at a temperature of from 10° C. to 40° C.

15. A method according to claim 1, wherein said structural element of concrete is selected from the group consisting of a pier, chimney, column, beam and slab.

16. A method according to claim 15, wherein said structural element of concrete is a concrete chimney.

17. A method according to claim 15, wherein said structural element of concrete is a concrete column.

* * * * *